US005439213A

United States Patent [19]

Pimentel

[11] Patent Number: 5,439,213

[45] Date of Patent: Aug. 8, 1995

[54] GOLF BALL AND TEE POSITIONING TOOL

[76] Inventor: Joseph A. Pimentel, 20 Toledo Ave., Pawtucket, R.I. 02860

[21] Appl. No.: 312,127

[22] Filed: Sep. 26, 1994

[51] Int. Cl.[6] ..... A63B 57/00

[52] U.S. Cl. ..... 273/32.5

[58] Field of Search ..... 273/32.5

[56] References Cited

U.S. PATENT DOCUMENTS

| | | | |
|---|---|---|---|
| 4,951,947 | 8/1990 | Kopfle | 273/32.5 |
| 4,969,646 | 11/1990 | Tobias | 273/32.5 |
| 5,330,178 | 7/1994 | Gelshert, Sr. | 273/32.5 |

*Primary Examiner*—William H. Grieb

[57] ABSTRACT

A tubular housing having a reciprocating rod directed therethrough, with the reciprocating rod having a handle at an uppermost end of the reciprocating rod, with a generally U-shaped frame mounted to the tubular housing, with the reciprocating rod extending within the U-shaped frame securing a head member within the U-shaped frame secured to the rod, with the U-shaped frame having a plate facing the head member, with the plate including a V-shaped slot and the head member having a cavity facing the slot to capture a golf ball between the head member and the slot. A mounting bracket is fixedly secured to the housing, having a spring plate at a first end of the mounting bracket to engage a golf ball bag, with a positioning spike secured to the mounting bracket, such that the positioning spike extends beyond the tubular housing, such that inverting the tubular housing permits projecting the spike member into a golf green turf to position the tubular housing during periods of non-use.

7 Claims, 5 Drawing Sheets

GOLF BALL AND TEE POSITIONING TOOL

TECHNICAL FIELD

The field of invention relates to golf ball and tee structure to permit the positioning and desired orientation of a golf ball tee and/or of a golf ball.

BACKGROUND OF THE INVENTION

Prior golf ball tee positioning structure is available and exemplified by the U.S. Pat. Nos. 4,142,719; 4,969,646; with golf ball and tee placement structure indicated in the U.S. Pat. Nos. 4,819,933; 5,080,357; and 4,949,961.

The instant invention attempts to overcome deficiencies of the prior art by providing for a golf ball and tee structure such that the same permits ease of positioning of a golf ball tee as an assembly in a desired orientation, as well as the ease of positioning the structure in turf and the like for temporary storage and placement.

SUMMARY OF THE INVENTION

The present invention relates to the positioning of a golf ball and tee, wherein the same includes a tubular housing, such that a plunger rod directed through the housing cooperates with a U-shaped frame to permit the frame to support a golf ball and tee structure. The tubular housing further includes a mounting bracket that has at one end thereof a mounting spring plate to engage a golf bag between the mounting spring plate and the tubular housing, with a spike member extending from a second end of the mounting bracket to permit the spike member to be projected to underlying turf for the support and storage of the unit between use thereof.

Objects and advantages of this invention will become apparent from the following description taken in conjunction with the accompanying drawings wherein are set forth, by way of illustration and example, certain embodiments of this invention.

The drawings constitute a part of this specification and include exemplary embodiments of the present invention and illustrate various objects and features thereof.

DESCRIPTION OF THE PREFERRED EMBODIMENT

Figure 1:
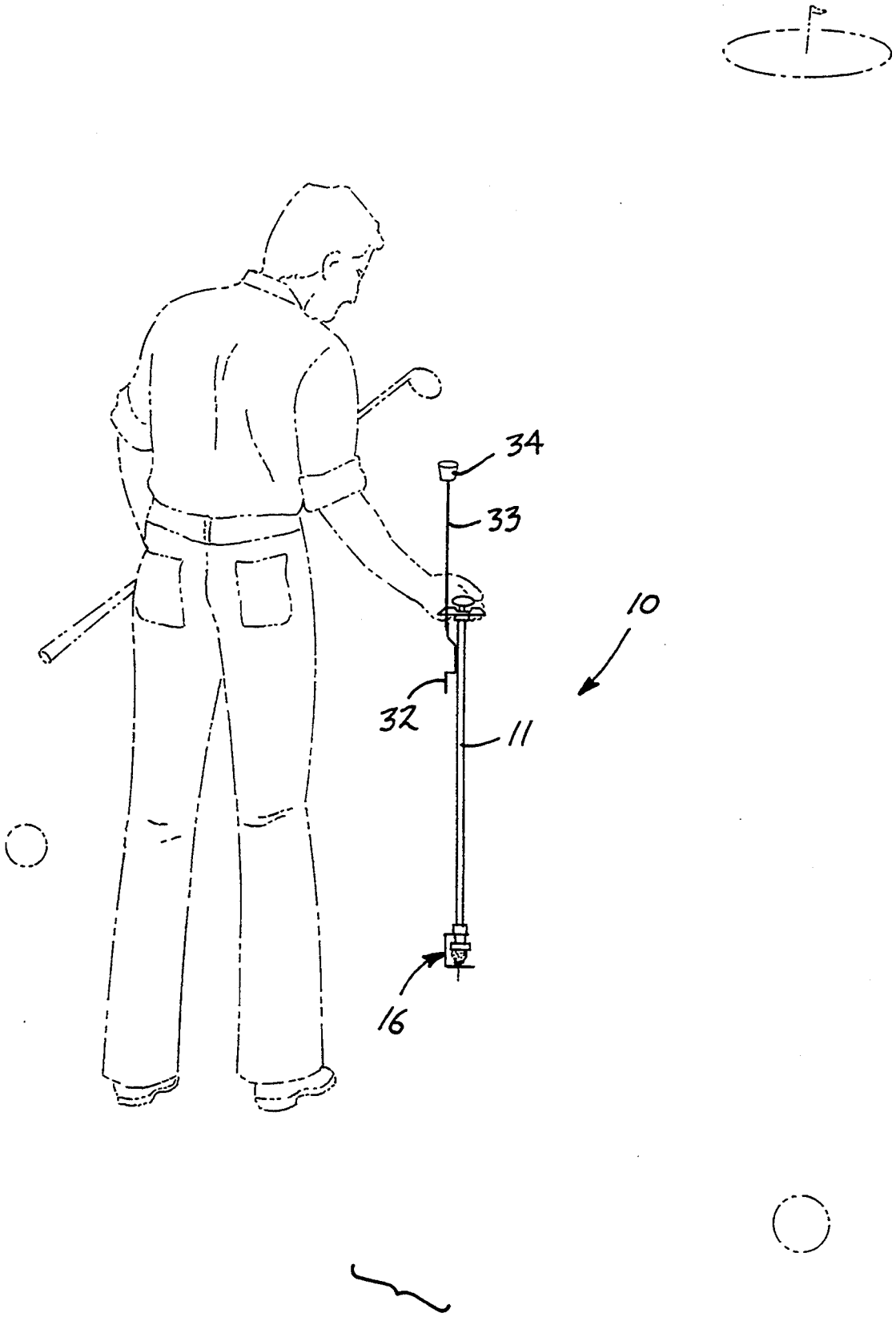
FIG. 1 is an isometric illustration of the invention in use.
Figure 2:
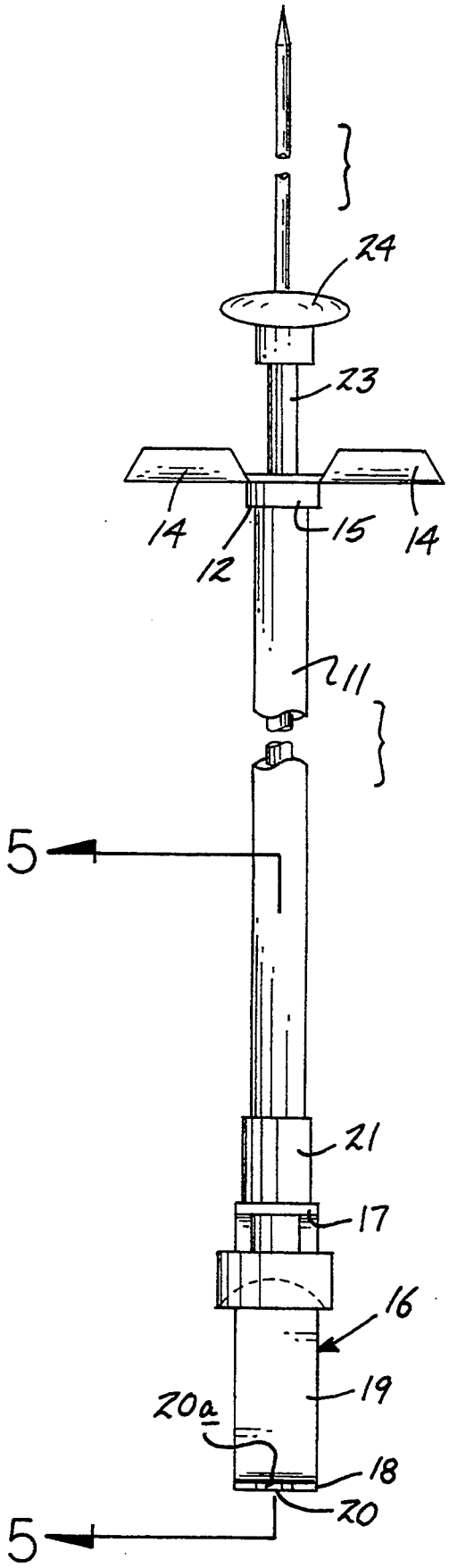
FIG. 2 is an orthographic front view of the invention.

As required, detailed embodiments of the present invention are disclosed herein; however, it is to be understood that the disclosed embodiments are merely exemplary of the invention, which may be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure.

The golf ball and tee positioning tool 10 of the invention comprises a tubular housing 11 of an elongate, axial aligned construction, such that the housing includes a housing first end 12 spaced from a housing second end 13. A handle member assembly 14 is mounted orthogonally relative to the housing first end 12. The assembly includes a plug 15 directed into the housing first end. The assembly includes a plurality of handle members that are oriented on diametrically opposed sides of the tubular housing 11. A U-shaped frame 16 is secured relative to the housing second end 13. The U-shaped frame 16 includes a first plate 17 spaced from a second plate 18 having a connecting web 19. A V-shaped slot 20 extends into the second plate 18 from its free distal end spaced from the connecting web 19. Further, it should be noted that the instant invention employs a concave, generally semi-cylindrical recess 202 directed into the top surface of the second plate 18 in a facing relationship relative to the first plate 17. This concave recess is arranged to seat the lowermost portion of a golf tee to maintain the golf tee at the apex of the V-shaped slot, such that the golf tee does not slide when pressure is applied to the golf ball and the golf tee by actuation of the handle 24 and plunger rod 23, as noted below. Without this concave recess, the golf tee would tend to slide and displace when pressure is thusly applied. Further, subsequently to the projection of the golf tee into an underlying turf, the weight of the tool permits the second plate 18 to drop relative to the bottom surface of the golf tee permitting easy removal of the tool relative to the golf ball and tee assembly when positioned within the underlying turf presenting such a golf ball and tee combination for subsequent use by a golfer. It is also noted that the actuation of the handle 24 and the plunger 23 is a similar action that is very naturally acquired by a golfer when projecting a golf ball and tee into the turf naturally, and this remote positioning of the golf ball and tee structure relative to the handle thereby incorporates this natural motion of a golfer while simultaneously permitting the golfer to project the golf ball and tee without undue bending and the like by the golfer. A boss 21 is fixedly mounted to an outermost portion of the first plate 17 projecting exteriorly of the U-shaped frame 16, such that the boss 21 is provided with a receiving socket 22 to fixedly receive the housing second end 13 therewithin. The receiving socket 22 includes a socket floor 27 arranged to engage the housing second end 13.

Figure 5:
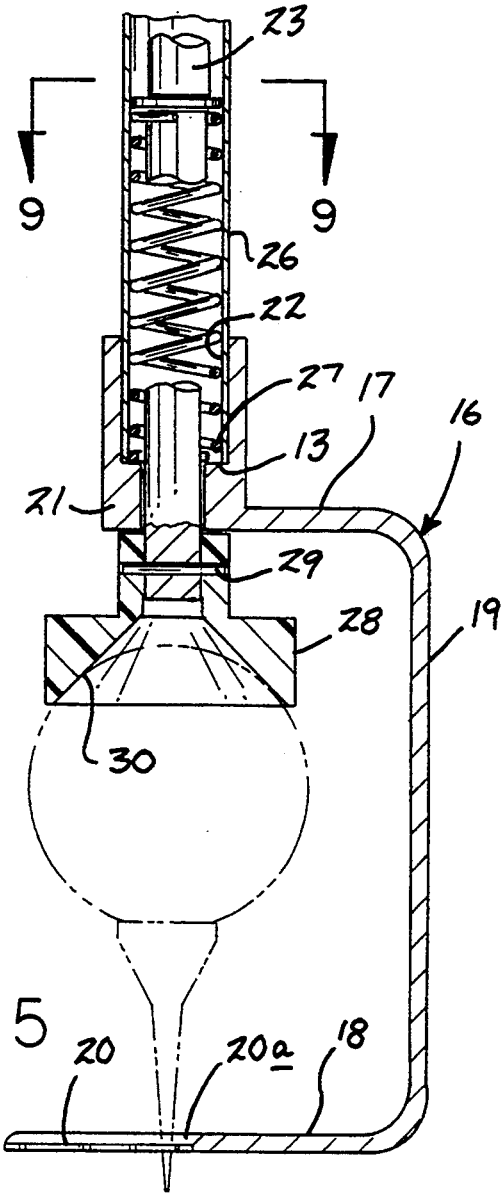
FIG. 5 is an enlarged orthographic view of a lowermost end portion of the invention.
Figure 6:
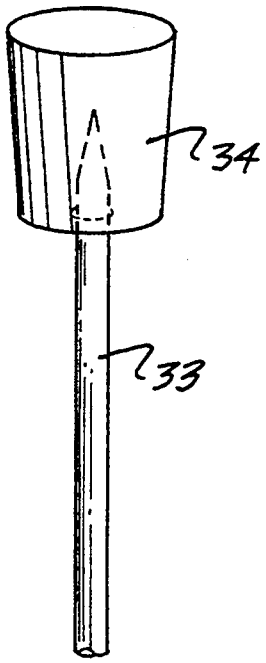
FIG. 6 is an enlarged isometric illustration of the spike member of the invention.

A plunger rod 23 is reciprocatably mounted throughout the tubular housing 11 extending beyond the housing first end 12 terminating in a handle 24 at a first end of the plunger rod 23. An abutment ring 25 is fixedly secured to the plunger rod 23 within the housing and spaced from the socket floor 27 to capture a spring member between the socket floor 27 and the abutment ring 25 to bias the plunger rod 23 and specifically the first end of the plunger rod from the housing 11. A second end of the plunger rod mounts a head member 28 thereto, with the head member 28 positioned between the first plate 17 and the second plate 18, with a pivot pin 29 mounting the head member 28 to the plunger rod second end. A semi-spherical cavity 30 is directed into the head member 28, such that the semi-spherical cavity 30 is in a facing relationship relative to the V-shaped slot 20. The V-shaped slot 20 accepts a tee member thereon, such as indicated in FIG. 5 for example, with a golf ball positioned between the tee member and received within the semi-spherical cavity 30. To this end, upon an individual player deciding upon the desired positioning of the tee member and golf ball, such is projected into the turf by directing the plunger rod 23 relative to the housing 11 and thereby project the golf ball and tee into the underlying turf.

Figure 3:
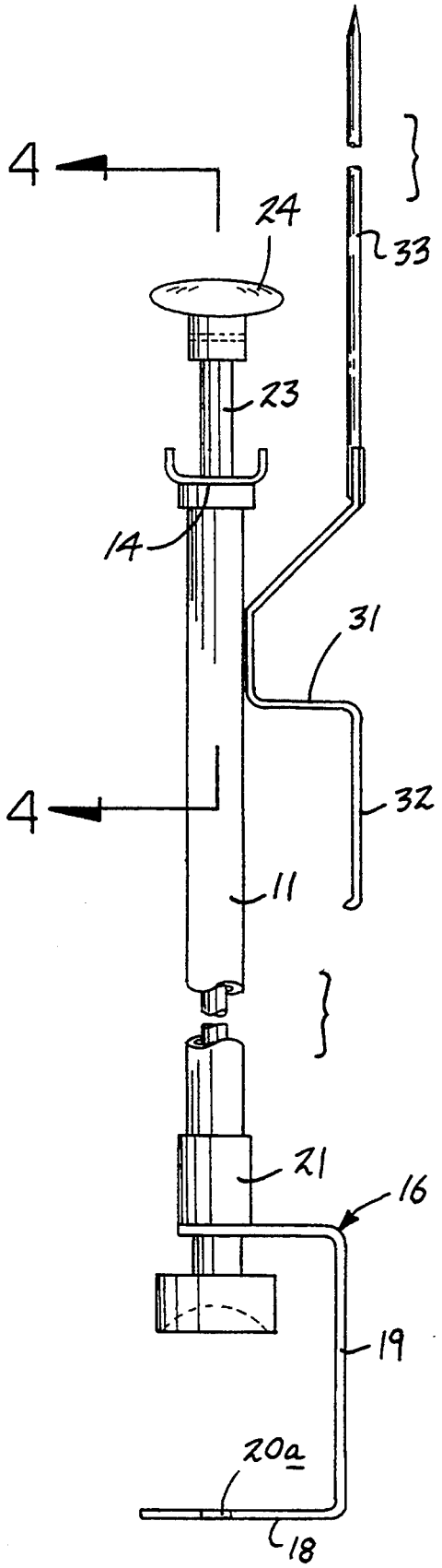
FIG. 3 is an orthographic side view of the invention.
Figure 4:
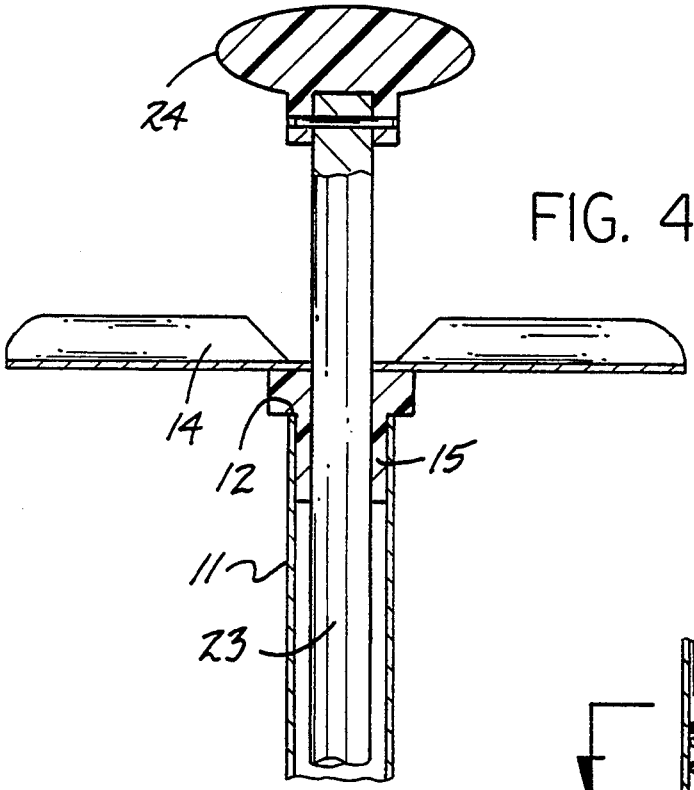
FIG. 4 is an orthographic view, taken along the lines 4—4 of FIG. 3 in the direction indicated by the arrows.
Figure 9:
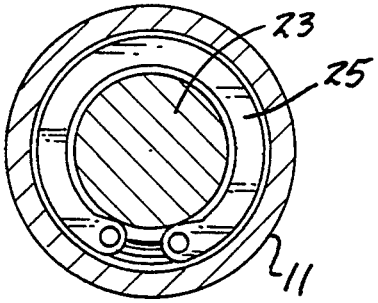
FIG. 9 is an orthographic view, taken along the lines 9—9 of FIG. 5 in the direction indicated by the arrows.
Figure 7:
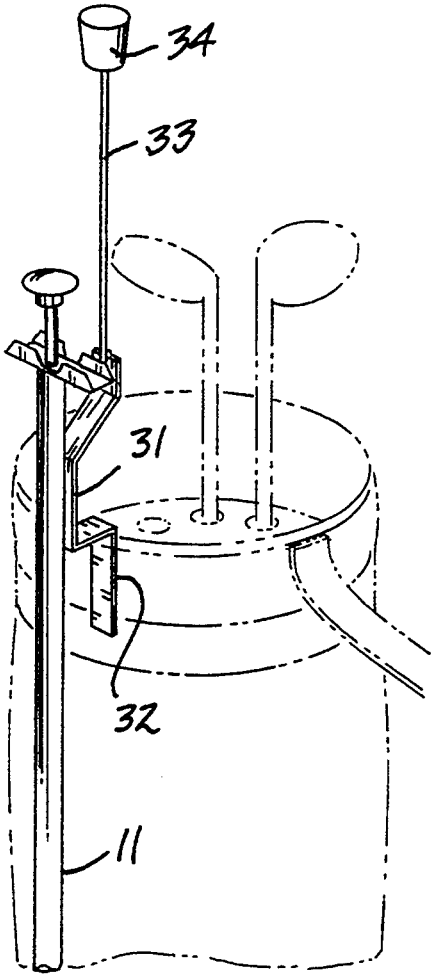
FIG. 7 is a partial isometric illustration of the invention indicating its use in securement to a golf bag.
Figure 8:
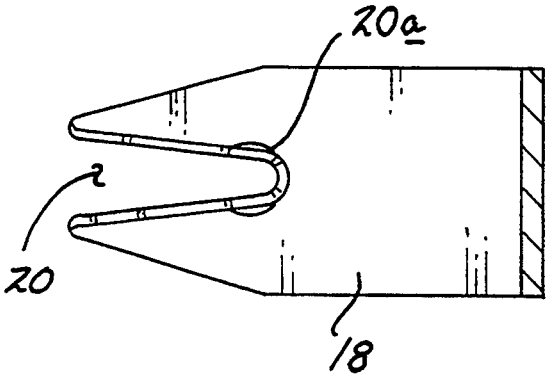
FIG. 8 is an enlarged plan view of the V-shaped slot directed into the U-shaped frame.

As illustrated for example in FIG. 3, a mounting bracket 31 is secured to the housing adjacent the housing's first end, such that a spring plate 32 is fixedly secured to a first end of the mounting bracket, such that the spring plate 32 is positioned in a spaced relationship relative to the housing 11 to engage a golf bag to thereby permit ease of transport of the invention. A spike member 33 extends from the second end of the mounting bracket and extends beyond the plunger rod handle, such as indicated in FIG. 7 and FIG. 3, such that the spike member 33 upon removal of a protective cap 34 permits the spike member to be directed into the underlying turf for temporary storage and placement of the invention during interim periods of its non-use.

It is to be understood that while certain forms of the present invention have been illustrated and described herein, it is not to be limited to the specific forms or arrangement of parts described and shown.

The foregoing is considered as illustrative only of the principles of the invention. Further, since numerous modifications and changes will readily occur to those skilled in the art, it is not desired to limit the invention to the exact construction and operation shown and described, and accordingly all suitable modifications and equivalents may be resorted to, falling within the scope of the invention.

What is claimed and desired to be protected by Letters Patent of the United States is as follows:

1. A golf ball and tee positioning tool, comprising, an elongate tubular housing, having a housing first end spaced from a housing second end, and a handle assembly fixedly secured to the housing first end, and a frame member secured to the housing second end, and a plunger rod reciprocatably directed through the tubular housing extending beyond the housing first end and beyond the housing second end, with the plunger rod having a rod first end extending beyond the housing first end, with the frame member having a first plate spaced from a second plate, and the plunger rod second end extending into the frame member between the first plate and the second plate, with the plunger rod second end having a head member secured thereto, the head member having a cavity in a facing relationship relative to the second plate, and a mounting bracket fixedly secured to the tubular housing adjacent to the housing first end, with the mounting bracket having a spring plate fixedly secured to the mounting bracket, the spring plate extending along the tubular housing in a spaced relationship relative to the tubular housing to permit engagement of a golf ball bag between the spring plate and the tubular housing.

2. A tool as set forth in claim 1 wherein the rod first end includes a handle fixedly secured thereto, with the handle oriented exteriorly of the tubular housing.

3. A tool as set forth in claim 2 wherein the second plate includes a V-shaped slot directed into the second plate at a free distal end of the second plate, with the V-shaped slot arranged in a facing relationship relative to the cavity.

4. A tool as set forth in claim 1 including a spike member fixedly secured to the mounting bracket, with the spike member extending beyond the rod handle.

5. A tool as set forth in claim 4 including a protective cap and the spike member having a spike member free end, and the protective cap arranged to receive the spike member free end.

6. A golf ball and tee positioning tool, comprising, an elongate tubular housing, having a housing first end spaced from a housing second end, and a handle assembly fixedly secured to the housing first end, and a frame member secured to the housing second end, and a plunger rod reciprocatably directed through the tubular housing extending beyond the housing first end and beyond the housing second end, with the plunger rod having a rod first end extending beyond the housing first end, with the frame member having a first plate spaced from a second plate, and the plunger rod second end extending into the frame member between the first plate and the second plate, with the plunger rod second end having a head member secured thereto, the head member having a cavity in a facing relationship relative to the second plate, and the second plate includes a V-shaped slot directed into the second plate at a free distal end of the second plate, with the V-shaped slot arranged in a facing relationship relative to the cavity, and a concave recess is directed into the second plate in a facing relationship relative to the first plate, wherein the concave recess is oriented at an apex of the V-shaped slot.

7. A tool as set forth in claim 1 with the first plate having a boss member, with the boss member having a receiving socket, the receiving socket having a socket floor, and the housing second end received within the receiving socket, and the plunger rod having an abutment member secured to the plunger rod, with a spring member captured between the abutment member and the socket floor.

* * * * *